United States Patent [19]

Werner

[11] Patent Number: 4,583,262

[45] Date of Patent: Apr. 22, 1986

[54] SPRING HINGE

[75] Inventor: Fred C. Werner, St. Louis County, Mo.

[73] Assignee: C. Hager & Sons Hinge Manufacturing Company, St. Louis, Mo.

[21] Appl. No.: 642,095

[22] Filed: Aug. 20, 1984

[51] Int. Cl.[4] ..... E05F 1/08

[52] U.S. Cl. ..... 16/300; 16/301; 16/381

[58] Field of Search ..... 16/300, 301, 307, 308, 16/381, 386

[56] References Cited

U.S. PATENT DOCUMENTS

| | | | |
|---|---|---|---|
| 142,855 | 9/1873 | Joyce | 16/300 |
| 387,421 | 8/1888 | Keil | 16/300 |
| 3,538,538 | 11/1970 | Field | 16/301 |
| 3,965,533 | 6/1976 | Frohlich | 16/300 |
| 4,339,845 | 7/1982 | Newlon et al. | 16/300 |
| 4,419,788 | 12/1983 | Prout | 16/300 |

*Primary Examiner*—Fred Silverberg

*Attorney, Agent, or Firm*—Gravely, Lieder & Woodruff

[57] ABSTRACT

One leaf of a spring hinge has a center knuckle and the other leaf has aligned top and bottom end knuckles which are spaced apart. The center knuckle of the one leaf fits between the two end knuckles of the other leaf and is maintained in alignment with them by top and bottom hinge pins, the former extending from the top knuckle into the center knuckle and the latter from the bottom knuckle into the center knuckle. Whereas the bottom pin is attached to the center knuckle, the top pin is attached to the top knuckle, but its angular position is easily changed. Each pin has a threaded portion that is located within the center knuckle, and the end convolutions on a coil-type torsion spring are threaded over these threaded portions to secure the spring to the hinge pins. Each hinge pin also has a shank which extends from its threaded portion through the interior of the spring where the ends of the two shanks abut. Thus, the spacing between the hinge pins is fixed and the two pins may be driven from the knuckle much like a conventional hinge pin. The torque exerted by the spring may be varied by changing the angular position of the top pin with respect to the top knuckle.

5 Claims, 6 Drawing Figures

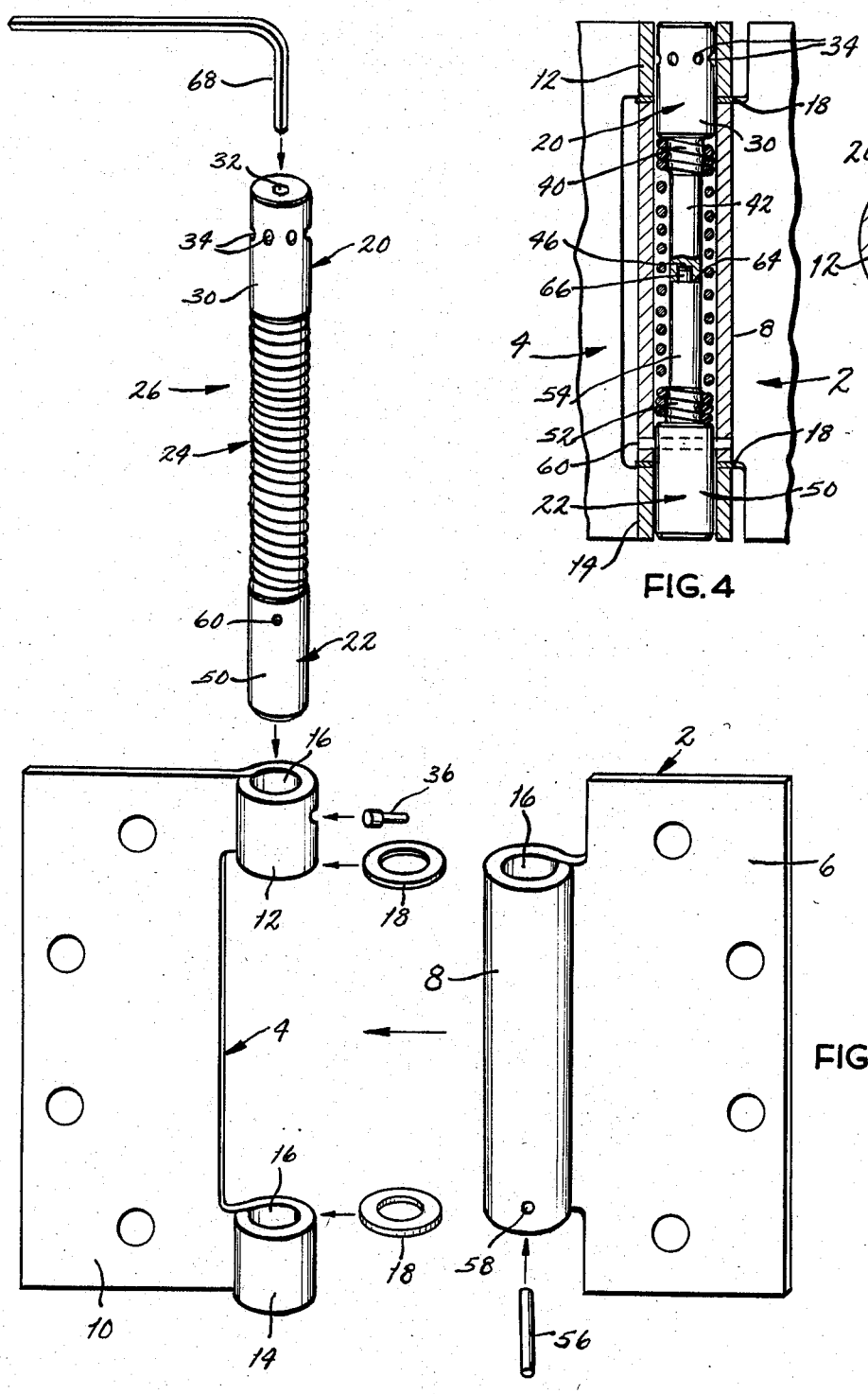
FIG. 3
FIG. 4
FIG. 5
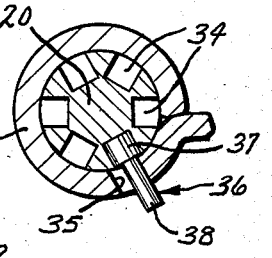
FIG. 6
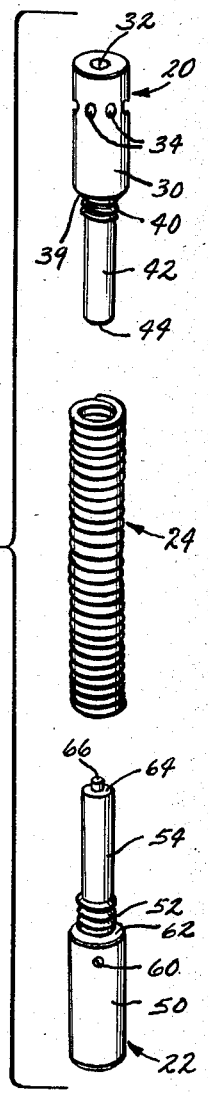

SPRING HINGE

BACKGROUND OF THE INVENTION

This invention relates in general to hinges and more particularly to spring hinges.

Whether it be by reason of building code requirements or mere convenience, some architectural doors should close automatically. For example, many building codes require that the doors to individual hotel and motel rooms must close when not otherwise restrained. Also, the doors which lead to fire escapes or service corridors in large buildings should normally be closed and therefore should seek a closed position when released.

Hydraulic door closers will automatically return doors to their closed positions, but these devices are expensive in their own right and are likewise expensive to install. Furthermore, the force exerted by a door closer generally requires reinforcement of the door and likewise the lintel to which the closer is attached.

So-called spring hinges are considerably less expensive than door closers, and provide an acceptable substitute for many doors which should close automatically. The typical spring hinge has relatively large knuckles through which a coil-type torsion spring extends, and this spring is at each of its ends attached to pins. The means for attaching vary. In some, the end of the spring merely winds around the pin and through friction grips the pin. This provides the possibility for slippage, and further requires a relatively large surface area for gripping. Of course, the portion of the spring that grips the pin is rendered ineffective insofar as applying the torque required to close the door on which the hinge is mounted. In others, the endmost convolutions of the spring are directed transversely and are received in slots in the hinge pins. While this arrangement provides a positive connection between the spring and the pins, it sets up high stress concentrations at the endmost convolutions of the spring.

Aside from the problems with the spring attachment, some spring hinges, once they are adjusted, cannot be readjusted to compensate for changes that may occur in the torsional characteristics of the spring. Similarly, certain conditions within a building may vary and require a change in the closing torques exerted by the door hinges. For example, new carpeting or a change in the pressure exerted by the air conditioning system may affect the doors.

Furthermore, all spring hinges of current manufacture are somewhat difficult to adjust and even more difficult to disassemble and likewise reassemble. These problems derive from the fact that the hinge pins are anchored by cross pins, and holes in the hinge pins must be aligned with corresponding holes in the knuckles. Also, the hinges pins, being segmented and detached, cannot be driven from the hinge with a drift as is true of the more traditional solid pin hinges, thus depriving the user of perhaps the most convenient way of removing the door for repairs.

SUMMARY OF THE INVENTION

One of the principal objects of the present invention is to provide a spring hinge which may be easily adjusted and readjusted if necessary. Another object is to provide a spring hinge of the type stated which is easily and quickly assembled and disassembled. A further object is to provide a spring hinge of the type stated in which the hinge pins occupy the full length of the aligned hinge knuckles and may accordingly be driven as a pivot pin unit from the hinge knuckles. An additional object is to provide a spring hinge of the type stated in which the ends of the spring positively interlock with the hinge pins without creating excessive stress concentrations in the ends of the pins. Still another object is to provide a spring hinge of the type stated that is simple in construction and economical to manufacture. These and other objects and advantages will become apparent hereinafter.

DESCRIPTION OF THE DRAWINGS

In the accompanying drawings which form part of the specification and wherein like numerals and letters refer to like parts wherever they occur

FIG. 3 is an exploded perspective view of the spring hinge;

FIG. 4 is a sectional view taken along line 4—4 of FIG. 1 and showing the pivot unit of the spring hinge partially broken away and in section;

FIG. 5 is a sectional view of the spring hinge taken along line 5—5 of FIG. 2; and FIG. 6 is exploded perspective view of the pivot pin unit for the spring hinge.

DETAILED DESCRIPTION

Figure 1:
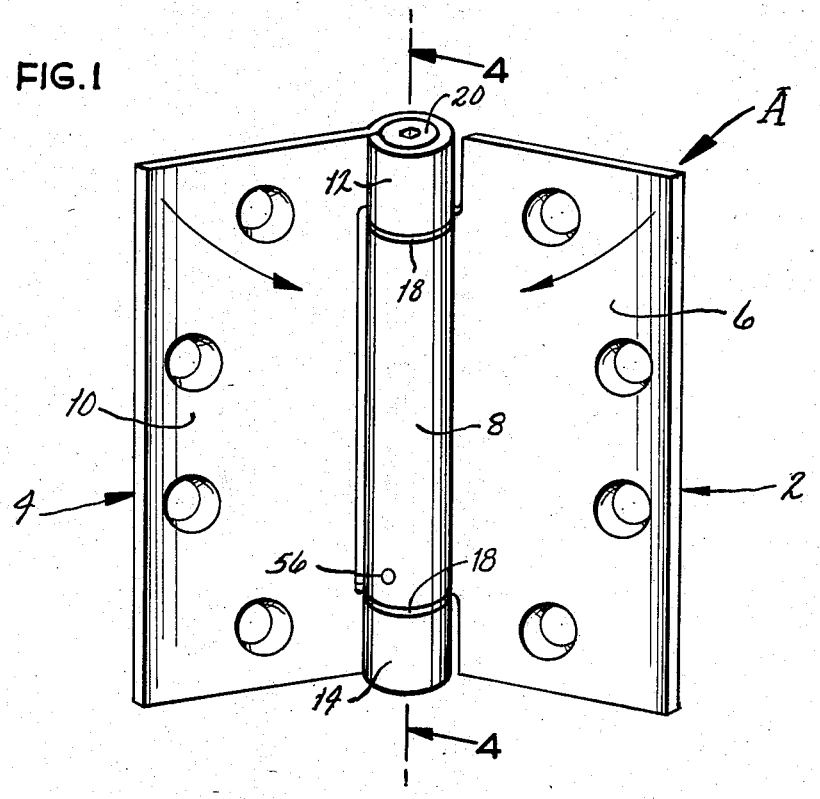
—FIG. 1 is a perspective view showing the front of a spring hinge constructed in accordance with and embodying the present invention, the hinge being partially open.

Referring now to the drawings, a spring hinge A (FIGS. 1 & 2) has a single leaf 2 and a double leaf 4 which pivot or swing relative to each other about a hinge axis X. As the name of the hinge implies, the leaves 2 and 4 are spring biased, that is they are urged toward a closed position in which they face each other, but may be moved away from that position against a restoring torque that is in effect the spring bias.

Figure 2:
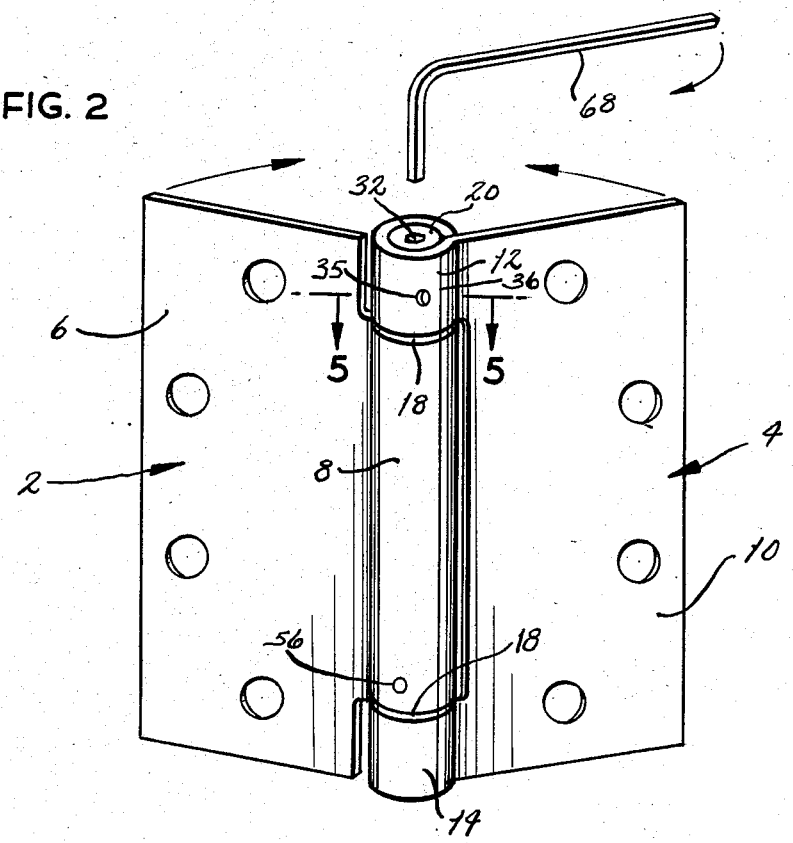
FIG. 2 is a perspective view of the back of the partially open spring hinge and further showing a hexagon wrench for adjusting the spring of the hinge.

The single leaf 2 has a mounting plate 6 and a center knuckle 8 that is rolled into a cylindrical configuration along one edge of the plate 6 (FIG. 1–3). The knuckle 8 is centered on that edge, its ends being squared off and spaced equally from the end edges of the mounting plate 6. The double leaf 4 likewise has a mounting plate 10, but instead of a single center knuckle 8, it has two knuckles 12 and 14 which are located along the end edges of the mounting plate 10 and are spaced apart a distance great enough to accommodate the center knuckle 8 of the leaf 2. The knuckles 12 and 14 are likewise rolled into a cylindrical configuration and have squared off ends. Each of the three knuckles 8, 12 and 14 has a cylindrical bore 16 (FIG. 3), and when the hinge A is assembled, the bores 16 of the three knuckles 8, 12 and 14 align along the axis X of the hinge A.

At each squared off end of the center knuckle 8 on the single leaf 2 is a bearing 18 (FIG. 3) formed from a low friction, yet extremely durable substance such as nylon in the form of a flat washer, and these bearings separate the ends of the knuckle 8 from the opposite squared off ends of top and bottom knuckles 12 and 14 on the other or double leaf 4. Traditional hinge bearings may be used in lieu of the washer-type bearings 18.

The two leaves 2 and 4 are held together, with their knuckles 8, 12 and 14 in alignment, by top and bottom hinge pins 20 and 22 (FIGS. 2 & 3). The top hinge pin 20 completely fills the bore 16 of the top knuckle 10, while the bottom pin 22 completely fills the bore 16 of the bottom knuckle 14. Both pins 20 and 22 moreover project into the center knuckle 8 of the single leaf 2 and in the region of entry pass through the bearings 18. The center knuckle 8 contains coiled torsion spring 24 which at its ends is secured to the pins 20 and 22, so that the two pins 20 and 22 together with the spring 24, form a pivot pin unit 26 that fills the aligned bores 16 of the three knuckles 8, 12 and 14. The top pin 20 is fastened so that it does not rotate with respect to the top knuckle 12, while the bottom pin 22 is secured against rotation relative to the center knuckle 8. Thus, the top pin 20 remains fixed in position with respect to the double leaf 4, while the bottom pin 22 remains fixed in position with respect to the single leaf 6. As a consequence, the spring 24 is twisted as the leaves 2 and 4 move relative to each other, and the twist is such that the stress within the spring 24 becomes greater as leaves 2 and 4 move apart. The spring 24 therefore exerts a greater torque on the pins 20 and 22, and this torque urges the leaves 2 and 4 toward their closed position, that is toward the position in which the two mounting plates 6 and 10 face each other and for all intents and purposes are against each other.

Considering the top hinge pin 20 with more particularity, it has a cylindrical head 30 (FIG. 4 & 6) that is somewhat longer than the top knuckle 12, and indeed it is the head 30 which completely fills the bore 16 of knuckle 12 and further projects through the top bearing 18 and into the to end of the bore 16 for the center knuckle 8. The diameter of the head 30 is small enough to enable the head 30 to rotate freely in the bores 16 of the knuckles 8 and 12 and to pass axially through all of the knuckles 8, 12 and 14, unless otherwise restrained, yet is large enough to prevent excessive free or radial motion. About 0.001 to 0.003 in. radial clearance is preferred between the cylindrical head 30 and the bores 16 in which it is contained. The top end of the head 30 is normally flush with the squared off upper end for the top knuckle 12, and opening out of the end of the head 30 is a hexagonal socket 32. That portion of the head 30 that is within the upper knuckle 12 is provided with a series of radially directed adjusting holes 34 (FIG. 5) which are arranged in a circle at equal circumferential intervals. The spacing between the circular row of holes 34 and the end of the pin 20 equals the spacing between the exposed end of the top knuckle 20 and a single hole 35 (FIGS. 2 & 3) which is bored into the upper knuckle 20. Thus, as the pin 20 is turned within the bore 16 of the top knuckle 12, the adjusting holes 34 come into alignment with and are exposed through the single hole 35 in the top knuckle 12, assuming, of course, that the end of the pin 20 remains flush with the end of the top knuckle 12.

The adjusting holes 34 of the pin 20 and the single hole 35 of the knuckle 12 are designed to accommodate a locking pin 36 (FIG. 5) having a head 37 that is small enough to fit through the hole 35 and into anyone of the adjusting holes 34, yet is large enough to be received relatively snugly in the holes 34. Moreover, the length of the head 37 is slightly less than the depth of the holes 34, so the head 37 will be totally contained in the hole 34 into which it is fitted. In addition, the locking pin 36 has a shank 38 which projects axially from the head 37, this shank being of lesser diameter than the head 38. Thus, when the head 37 of the pin 36 is fitted into a radial adjusting hole 34 that is exposed through the single hole 35, the shank 38 will project from the slot 35. If the upper pin 20 is allowed to turn minutely to slightly misalign the single hole 35 with the adjusting hole 34, the shank 38 of the locking pin 36 comes to the wall of the slot 35, and a segment of the head 37 will underlie the margin of the adjusting hole 35, so that the locking pin 36 cannot be withdrawn from the hole 35 (FIG. 5). The locking pin 36 serves to resist the torque applied by the spring 24 or more accurately to transfer that torque from the top hinge pin 20 to the top knuckle 12, and therefore when the spring 24 is exerting a torque, the two holes 34 and 35 will be slightly offset so that the locking pin 36 cannot work out or be extracted.

While the portion of the head 30 that is within the top knuckle 12 is by reason of the pin 36 secured against rotation in the knuckle 12, the portion that is within the upper end of the center knuckle 8 is free to rotate with respect to that knuckle and indeed serves as one of two journals which accommodate the pivotal or swinging movement of the leaves 2 and 4. The head 30 of the top pin 20 terminates at a shoulder 39 (FIGS. 4 & 6) from which a short threaded portion 40 extends concentric to the axis of the pin 20.

The threaded portion 40 carries a single left hand thread of about three turns and the pitch and direction of the thread correspond to the pitch and direction of the convolutions at the ends of the spring 24. Moreover, the profile of the thread likewise corresponds to the profile of the convolutions along the inside of the end of the spring 24. Indeed the end of the spring 24 is turned down over the threaded portion 40 until its end comes against the shoulder 39.

The top pin 20 continues axially beyond the threaded portion 40 in the form of a shank 42 (FIGS. 4 & 6), the diameter of which is small enough to fit loosely within the inside of the spring 24 without binding, even when the spring 24 is under considerable torque. The shank 42, which is of constant diameter, terminates at a squared off end face 44 which is located midway between the ends of the spring 24 and likewise midway between the ends of the center knuckle 8 when the application of the pin 20, that is the squared off end face of the head 30 is flush with the end of the top knuckle 12. The shank 42 contains a short cylindrical socket 46 (FIG. 4) that opens out of its squared off end face 44.

The bottom hinge pin 22 resembles the upper pin 20 in that it likewise has a cylindrical head 50, a threaded portion 52, and a shank 54 (FIGS. 4 & 6), all of which are quite similar to their counterparts on the top pin 20. More specifically, the head 50 has the same diameter and length as the head 30 of the top pin 20, and accordingly when its end is flush with the end of the bottom knuckle 14, the head 50 extends through the bottom bearing 18 and into the lower end of the center knuckle 8, to which it is secured by a cross pin 56 (FIG. 3) that passes through aligned holes 58 and 60 in the center knuckle 8 and head 50, respectively. An interference fit exists between the cross pin 56 and the hole 58 through the head 50, so that the pin 56, once it is driven into the hole 60, will not fall or work its way out of the bottom pin 20 or center knuckle 8.

The bottom pin 22 is secured against rotation relative to the center knuckle 8, but is free to rotate relative to the bottom knuckle 14, and indeed the portion of the head 50 that is within the bottom knuckle 14 serves as the other of the two journals for accommodating the pivoting of the two leaves 2 and 4.

The threaded portion 52 extends axially from a shoulder 62 on the head 50 (FIGS. 4 & 6), and like the threaded portion 40 of the top pin 12, it has a single left hand thread of about three turns. This thread corresponds in pitch, direction and contour to the convolutions at the lower end of the spring 24, and indeed the lower end of the spring 24 is turned down over the threaded portion 52 until the endmost convolution comes against the shoulder 62.

The shank 54 extends axially beyond the threaded portion 52, it having the same diameter as the shank 42 of the top pin 20, and terminates at a squared off end face 64 from which a cylindrical pintle 66 (FIGS. 4 & 6) projects, likewise concentric to the axis of the bottom pin 22. The end face 64 is located midway between the ends of the center knuckle 8 where it abuts the end face 44 on the shank 42 of the top pin 20. The pintle 66 fits loosely into the socket 46 at the end of the top pin 20 and maintains the shanks 42 and 54 of the two pins 20 and 22 aligned.

The spring 24 (FIGS. 3, 4 & 6) has its convolutions wound in the left hand direction with the last few convolutions at both ends being in contact with each other to form female threads which match the threaded portions 40 and 52 of the two pins 20 and 22. Indeed, the end convolutions of the spring 24 are threaded counterclockwise over the two threaded portions 40 and 52 until the endmost convolutions come against the shoulders 39 and 62 on the pins 20 and 22. When the spring 24 is unrestrained its length is slightly less than the distance between the two shoulders 40 and 52, assuming the end faces 44 and 64 are abutting. As a consequence the spring 24 draws the two pins 20 and 22 toward each other and maintains the end faces 44 and 64 of the shanks 42 and 54 in abutment when the pivot pin unit 26 formed by the two pins 20 and 22 and the spring 24 is detached from the leaves 2 and 4. The inside diameter of the spring 24 is small enough to accommodate the shanks 42 and 54 on the two pins 20 and 24 without binding, even when considerable torque is applied to the spring 24 by turning one hinge pin 20 clockwise relative to the other, that is, in the direction that causes the spring 24 to contract. While this direction is the same as the direction that causes the ends of the spring 24 to back off of the threaded portions 40 and 52, the friction caused by the contraction of the spring 24 about the threaded portions 40 and 52 is so great that when the clockwise torque is applied to the spring 24, its ends do not turn on the threaded portions 40 and 52, but instead remain firmly against the shoulders 39 and 62. The outside diameter of the spring 24 is slightly less than the diameter of the aligned bores 16 through the knuckles 8, 12 and 14.

The hinge A is supplied with its pivot pin unit 26, that is the two pins 20 and 22 and the spring 24, extended through the aligned bores 16 of the three knuckles 8, 12 and 14 as well as through the bearings 18 that separate the end knuckles 12 and 14 from the center knuckle 8. Moreover, the cross pin 56 is in place, that is driven into the hole 58 through the head 50 on the bottom pin 20 with its ends being in the hole 58 through the center knuckle 8. This secures the bottom pin 22 in the center knuckle 8 with the squared off end of its head 50 located flush with the end of the bottom knuckle 14. It also positions the top pin 20 with the squared off end of its head 30 flush with the end of the top knuckle 12, and in that position the circle along which the radial holes 34 lie aligns with the single hole 35 in the uppe knuckle 12.

In this regard, it will be recalled that the spring 24 draws the end faces 44 and 64 of the two shanks 42 and 54 together so that the spacing between the two heads 30 and 50 remains constant, irrespective of the position of angular rotation between the two heads 30 and 50. Thus the shanks 42 and 54 together function as a spacer that positions the two cylindrical heads 30 and 50 at a predetermined spacing. Moreover, the pintle 66 on the end of the bottom pin 22, by reason of its extension into the socket 46 in the end of the top pin 20, keeps the two pins 20 and 22 aligned along the axis X. Thus, in the condition in which the hinge A is supplied the two leaves 2 and 4 are capable of pivoting relative to each other much like any other door hinge and will remain in the position to which they are turned. In short, the spring 24 exerts no torque on the leaves 2 and 4.

The hinge A is further fitted to a door and door jamb much like a conventional hinge. However, once the hinge A is installed, its spring 24 is set to exert a torque on the two leaves 2 and 4, and that torque is applied in the direction which urge the leaves to their closed position. This, of course, exerts a closing force on the foor and urges it to a closed position.

To set the spring 24, the hexagonal wrench 68 is fitted into the socket 32 at the end of the top pin 20 and turned clockwise, which is the direction which causes the spring 24 to contract more tightly about the threaded portions 40 and 52 of the two hinge pins 20 and 22. As the upper pin 20 turns, the radial holes 34 in its head 30 pass by the single hole 35 in the top knuckle 12 where they are exposed one at a time. In this regard, the top pin 20 does not tend to drift downwardly or upwardly because it remains in contact with the bottom pin 22, and therefore the holes 34 remain vertically aligned with the hole 35. When the spring 24 exerts the desired amount of torque, the locking pin 36 is inserted head 37 first through the single hole 35 and into the radial adjusting hole 34 that is exposed through the hole 35. The head 37 of the pin 36 fits totally within that radial hole 34, while the shank 38 projects outwardly through the hole 35 in the knuckle 12. Then the torque applied by the wrench 38 is released and the spring 24 brings the shank 38 of the locking pin 36 against the wall of the hole 35. The spring 24 exerts a torque on the top hinge pin 20, and the locking pin 36, by reason of its shank 38 being against the wall of the hole 35 in the top knuckle 12, transmits this torque to the top knuckle 12 and the double leaf 4 of which it forms a part (FIG. 5). Since the head 37 of the locking pin 36 lies in part behind the margin of the single hole 35, the locking pin 36 cannot work out of the top hinge pin 20 as the door is opened or closed, nor can it be extracted without the wrench 68.

The spring 24, of course, exerts the same torque on the bottom hinge pin 22, and this torque is transmitted to the center knuckle 8 and the lead 2, of which it forms a part, through the cross pin 56. The torque urges the two leaves 2 and 4 together, that is to the closed position for the hinge A.

Once the hinge A is adjusted, it may be readjusted to either increase or decrease the torque applied by the spring 24, and this readjustment is achieved merely by again inserting the hexagonal wrench 68 into the socket 32 at the end of the top pin 20 and turning the top pin 20 a slight distance against the spring torque until the locking pin 36 is centered with respect to the single hole 35 in the top knuckle 12. This brings the head 37 out from under the margin of the hole 35, and the locking pin 36 is merely gripped at its shank 38 and pulled from its radial hole 34 and the single hole 35. Then the wrench 68 is turned until the desired torque is present, whereupon the locking pin 36 is inserted into whatever radial hole 34 is at the single hole 35.

Often the most convenient way to remove a door from its door frame is to drive the hinge pins from the hinges which support the door on the frame. The hinge A, in contrast to conventional spring hinges, affords this convenience. To separate the two leaves 2 and 4, the locking pin 36 is first withdrawn from the top pin 20 and top knuckle 12 using the hexagon wrench 68 as previously described. Then the cross pin 56 is driven out of the aligned holes 58 and 60 it occupies in the center knuckle 8 and bottom pin 22, and this requireS a small drift.

If the pivot pin unit 26 consisting of two hinge pins 20 and 22 and the spring 24 does not fall from the aligned knuckles 8, 12 and 14 at this time, it may be driven from them with a drift of appropriate size. The drift should be placed against the squared off end face on the head 30 of the top pin 20 or the head 50 on the bottom pin 22. In either case, the impacts derived from the drift are transferred to the other pin 20 or 22, because the shanks 42 and 54 of the two pins 20 and 22 abut midway between the ends of the spring 24. In effect, the shanks 42 and 54 together serve as a spacer between the cylindrical heads 30 and 50 of the hinge pins 20 and 22, respectively, and transfer, impacts applied agains one head to the other head.

By the same token, the pivot pin unit 26 consisting of the two pins 20 and 22 and the spring 24 is inserted through the hinge knuckles 8, 12 and 14 to reassemble the hinge A just as a conventional hinge pin is replaced. If this requires driving the pivot pin unit 26 with a hammer, any impacts applied to the top pin 20 will be transferred to the bottom pin 22 or vice-versa. Once the hole 60 in the bottom pin 22 is aligned with the hole 58 through the center knuckle 8, the cross pin 56 is driven through those holes. Then the spring 24 is set and the locking pin 36 installed in the top pin 20 at the hole 35 of the knuckle 12.

Thus, the hinge A is easy to adjust in the sense that the torque exerted by its spring 24 may be varied. It may also be easily disassembled to remove the door that it normally supports, this being achieved by driving the pivot pin unit 26 from the aligned knuckles 8, 12 and 14 much in the same manner that a conventional hinge pin is driven from the knuckles of a conventional hinge. By the same token, the hinge A is easily assembled.

This invention is intended to cover all changes and modifications of the example of the invention herein chosen for purposes of the disclosure which do not constitute departures from the spirit and scope of the invention.

What is claimed is:

1. A hinge comprising:

(a) a first leaf having spaced apart first and second knuckles provided with axially aligned bores of equal diameter which define a hinge axis;

(b) a second leaf having a knuckle located between the first and second knuckles of the first leaf and also having a bore which is equal in diameter to the bores of the first leaf and aligns axially with the bores of the first leaf;

(c) a unitary pivot extending through the bores of the knuckles for the first and second leaves and being capable of being installed in and removed from the bores as a unit, the pivot including:

(1) a first hinge pin element located in the bore of the first knuckle for the first leaf and in the bore of the knuckle for the second leaf and having a cylindrical portion at least within the bore of the knuckle for the second leaf and also having a threaded portion, (2) a second hinge pin element located in the bore of the second knuckle for the first leaf and in the bore of the knuckle for the second leaf and including a cylindrical portion that is at least in the bore of the second knuckle for the first leaf and also having a threaded portion that is presented generally toward the threaded portion of the first hinge pin element, (3) a spacer located between and being engaged and axially aligned with the hinge pin elements for preventing the hinge pin elements from moving axially together so as to establish a predetermined spacing between the cylindrical portions, and (4) a coil-type torsion spring surrounding the spacer and being within the bore of the knuckle for the second leaf and at one end being threaded onto the threaded portion of the first hinge pin element and at its other end being threaded onto the threaded portion of the second hinge pin element such that the ends of the springs will not rotate relative to the pin elements onto which they are threaded, nor will they move axially off of the pin elements, the spring holding the two hinge pin elements together with the axial spacing between the pin elements when they are so held being substantially that established by the spacer so that the spacing between the pin element is substantially fixed at all times, the spring being small enough in diameter to slide through the bores of the knuckles, at least one of the hinge pin elements being no greater in diameter than the bores of the knuckles, so that when the pivot unit is not secured to any one of the knuckles, it may be moved as a unit axially through the bores and out of the knuckles; and (d) first locking means for securing the first hinge pin element against rotation with respect to the first knuckle of the first leaf and second locking means for securing the second hinge pin element against rotation with respect to the knuckle of the second leaf, so that when the spring is twisted, the torque it exerts on the hinge pin elements will be transmitted to the leaves, at least one of the locking means including a securing element which extends transversely from the knuckle to the hinge pin element that it secures and is removable from the knuckle and hinge pin element, so that the two may be detached, the other locking means being arranged to, upon manipulation, detach the hinge pin element and knuckle with which it is associated, whereby the pivot may be driven as a unit from or driven as a unit into the aligned bores of the knuckles, and when so driven, will remain unitary and of a fixed length.

2. A hinge according to claim 1 wherein the second locking means comprises a pin which extends transversely through the knuckle and hinge pin element that it secures to that knuckle.

3. A hinge according to claim 2 wherein the first locking means comprises a pin which fits into a socket in the hinge pin element that it secures and projects through an aperture in the knuckle to which the hinge pin element is secured.

4. A hinge according to claim 1 wherein the first locking means secures the first hinge pin element to the first knuckle of the first leaf and the second locking means secures the second hinge pin element to the knuckle of the second leaf.

5. A hinge according to claim 1 and further comprising means for adjusting the angular position of the first pin element in the first knuckle to change the torque exerted by the spring.

* * * * *

UNITED STATES PATENT AND TRADEMARK OFFICE

CERTIFICATE OF CORRECTION

PATENT NO. : 4,583,262

DATED : April 22, 1986

INVENTOR(S) : Fred C. Werner

It is certified that error appears in the above-identified patent and that said Letters Patent are hereby corrected as shown below:

Column 2, line 16, the description of FIG. 1 should be a new paragraph.

Column 3, line 7, "a" should be inserted after "contains".

Column 3, line 32, "to" should be "top".

Column 4, line 43, "application" should be "opposite end".

Column 5, line 68, "uppe" should be "upper".

UNITED STATES PATENT AND TRADEMARK OFFICE

CERTIFICATE OF CORRECTION

PATENT NO. : 4,583,262

DATED : April 22, 1986

INVENTOR(S) : Fred C. Werner

It is certified that error appears in the above-identified patent and that said Letters Patent are hereby corrected as shown below:

Column 7, line 15, "requireS" should be "requires".

Column 7, line 30, the comma after "transfer" should not be there.

Column 8, line 29 , "springs" should be "spring".

Signed and Sealed this

*Twenty-second* Day of *July 1986*

[SEAL]

*Attest:*

*Attesting Officer*

DONALD J. QUIGG

*Commissioner of Patents and Trademarks*